United States Patent [19]

McAuley et al.

[11] Patent Number: 4,978,113

[45] Date of Patent: Dec. 18, 1990

[54] PICK MECHANISM FOR SHEET FEEDING APPARATUS

[75] Inventors: Kenneth A. McAuley, Framingham; Frank S. Silveira, Norwood, both of Mass.

[73] Assignee: Polaroid Corporation, Cambridge, Mass.

[21] Appl. No.: 402,656

[22] Filed: Sep. 5, 1989

[51] Int. Cl.[5] ..... B65H 3/24

[52] U.S. Cl. ..... 271/10; 271/21; 271/42; 271/111

[58] Field of Search ..... 271/10, 19, 21, 42, 271/128, 130, 111

[56] References Cited

U.S. PATENT DOCUMENTS 2,672,244 3/1954 Van Schie ..... 271/42 X 3,350,090 10/1967 Larson ..... 271/42

*Primary Examiner*—Richard A. Schacher

*Attorney, Agent, or Firm*—Karl Hormann

[57] ABSTRACT

A pick mechanism for sheet feeding apparatus of a type in which the top sheet of a stack of media is separated from the remainder of the stack by pick movement to engage and lift the rear end of the top sheet from the remainder of the stack for subsequent separation and feeding from the stack, and including means for lifting the pick independently of elevating movement caused by engagement of the pick with a sheet. The pick lifting arrangement operates to lift the pick in the event of a failure thereof to engage the rear edge of a sheet and also to gently lower the pick back onto the next successive top sheet in the stack to be fed. A detector system is provided by which the conditions of sheet feed due to pick movement are detected and used to control driving components associated with the apparatus.

16 Claims, 3 Drawing Sheets

PICK MECHANISM FOR SHEET FEEDING APPARATUS

BACKGROUND OF THE INVENTION

This invention relates to sheet feeding apparatus and, more particularly, to a pick control arrangement for sheet feeders adapted to separate and feed individual sheets of media from a stack, especially but not exclusively plastic sheets which have a low coefficient of friction and a tendency to adhere to each other by electrostatic attraction.

In a commonly assigned, co-pending U.S. patent application entitled "SHEET FEEDING METHOD AND APPARATUS", Ser. No. 324,036, filed Mar. 16, 1989, a method and apparatus is disclosed by which individual sheets of plastic media are separated and fed from the top of a supply stack by engaging and flexing the rear end portion of the uppermost sheet in the stack to an elevated position so that a translating lifting roller may pass under the sheet, progressively separate it from the stack and move into a pressure nip relationship with a rotatable driving roller to feed the separated top sheet from the stack. The initial separation of the rear edge of the top sheet is effected by a pick member supported by a downwardly and rearwardly oriented arm pivotally connected to the pick member at one end and at the other end to a translating carriage elevated above the media stack and the translating path of the lifting roller. The pick member is shaped as an elongated body with a bottom surface adapted to lie on the rear end portion of the media stack and having a forwardly directed claw depending from the bottom surface by approximately the thickness of one sheet of the media to be fed.

Experimentation with the apparatus of the aforementioned co-pending patent application has demonstrated a high degree of reliability and effectiveness in feeding sheets of plastic media from the top of a stack of such sheets. On the other hand, the same experimentation has demonstrated a need for improvement particularly in control over movement of the pick member after one sheet is fed and the pick is returned to the top rear edge of the next sheet. For example, after the top sheet is lifted by the pick member, the translating lifting roller begins to take control of the sheet and ultimately feeds the sheet away from the pick member. The pick member then drops down against the top of the stack and is slid back to begin the next feed cycle. Because of the relatively fragile character of the sheet media surfaces, the impact of the pick member fall and sliding movement thereof on the top surface of the top sheet can and has resulted in scratching the media. Also in the event that the pick fails to engage and lift the rear edge of the top sheet of the media, necessitating a return of the pick to the rear end of the stack, even more severe damage may be inflicted by the fore and aft sliding movement of the pick on the top surface of the media.

Other problems encountered as a result of the freely pivoted pick member of the apparatus described is the obstruction represented by the pick to the insertion of a cassette containing the stack of sheet media into a position from which the media can be fed. Because in operation, the pick is required to move freely, the need for lifting it out of the way for cassette loading was evident but not easily satisfied without complicated and expensive additional mechanical components. Further, and because of the potential for failure of the pick to engage and lift a sheet as well as for the pick to lift more than one sheet, the need surfaced for a reliable detection system by which the absence of pick engagement or the feeding of more than one sheet could be detected and the detection used to return the pick for another feed cycle without damage to the media.

It is apparent, therefore, that while the sheet feeding apparatus of the aforementioned co-pending application represents a significant and an important advance in the handling and feeding of plastic sheet media, there is need for improvement.

SUMMARY OF THE INVENTION

In accordance with the present invention, an improved pick mechanism and sheet feed detection system is provided for sheet media feeding apparatus of the type described above and by which control of pick movement and positioning may be effected simply by controlling the positioning of the carriage from which the pick mechanism is supported.

In a preferred embodiment of the invention, the freely pivotal movement of the pick to engage the rear edge of each successive sheet in a cassette supported stack is maintained with a provision for lifting the pick to an elevated, out-of-the-way, retracted position permitting cassette insertion and removal without interference by the pick. The pick lifting provision is embodied in a flexible cable connected to the arm supporting the pick and trained in a path by which it operates to lift the pick only during the final portion of pick carriage movement during pick operation to engage and lift the top sheet in the stack to a position for operation of the lifting roller. The length of the cable is adjusted so that it remains slack and thus has no effect during the portion of each pick operating cycle when the pick comes to rest on the rear end of the next top sheet to be fed. Moreover, the measure of slack is selected so that the cable has no effect on pick positioning on the top sheet throughout the height of the cassette contained stack, thus avoiding the need for a follower mechanism to maintain the successive top sheets at a predetermined elevation. The pick lifting arrangement facilitates a sheet feed detection system by which failure of the pick to engage a single sheet from the top of the stack may be detected and subsequent pick movement controlled solely by controlling the drive for the pick supporting carriage.

Among the objects of the present invention, therefore, are the provision of an improved pick mechanism for sheet feeders of the type described, the provision of a lifting arrangement for such pick mechanisms which is exceedingly simple in the context of required components and yet highly effective in operation, and the provision of an improved sheet feed detect system by which the pick lifting arrangement may be deployed to insure reliable feeding of sheets, one at a time, and also minimize the potential for sheet damage by the pick. Other objects and further scope of applicability of the present invention will become apparent from the detailed description to follow, taken in conjunction with the accompanying drawings in which like parts are designated by like reference characters.

DETAILED DESCRIPTION OF THE PREFERRED EMBODIMENTS

Figure 1:
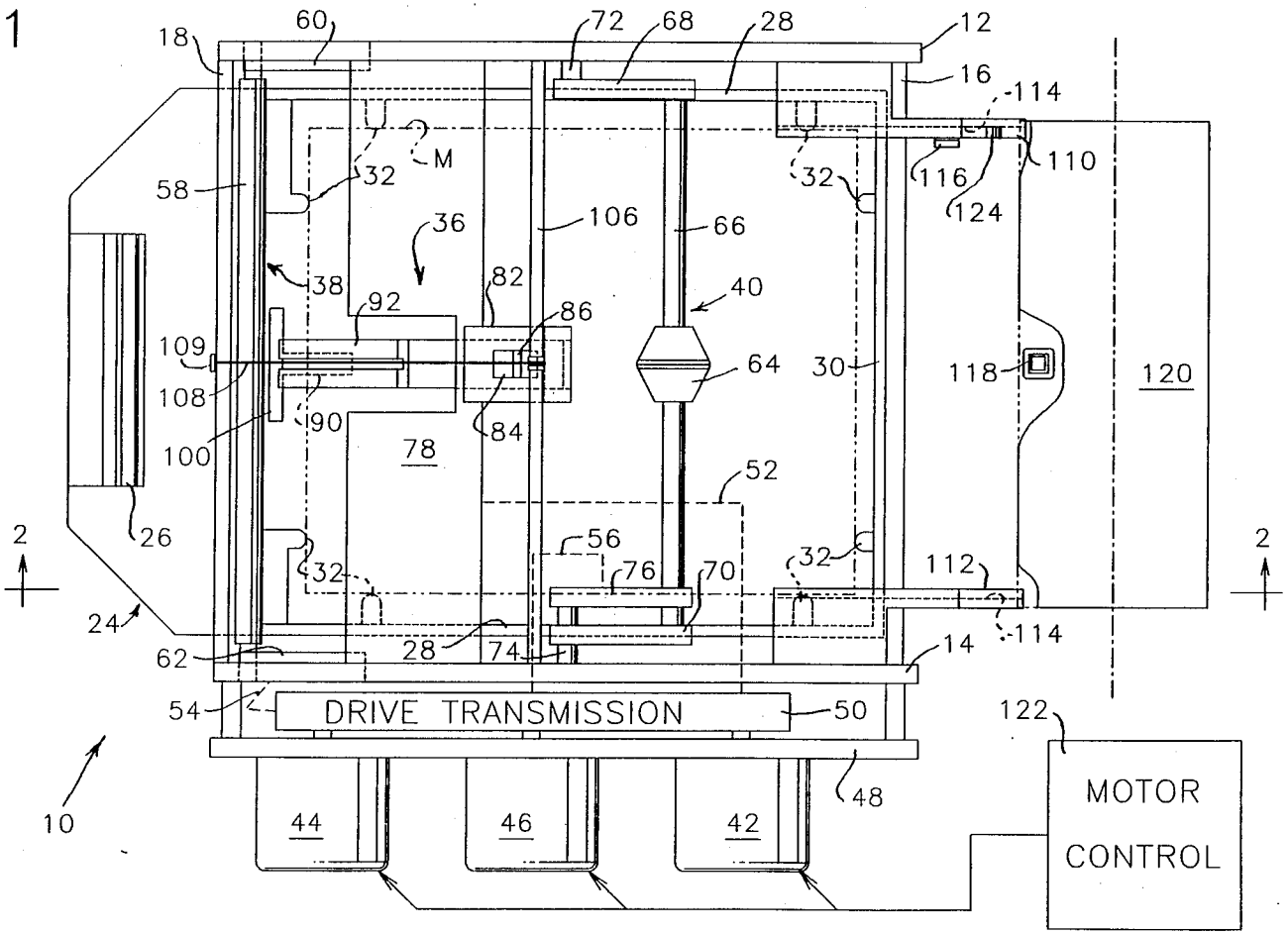
FIG. 1 is a partially schematic plan view of a sheet feeding apparatus incorporating the present invention.
Figure 2:
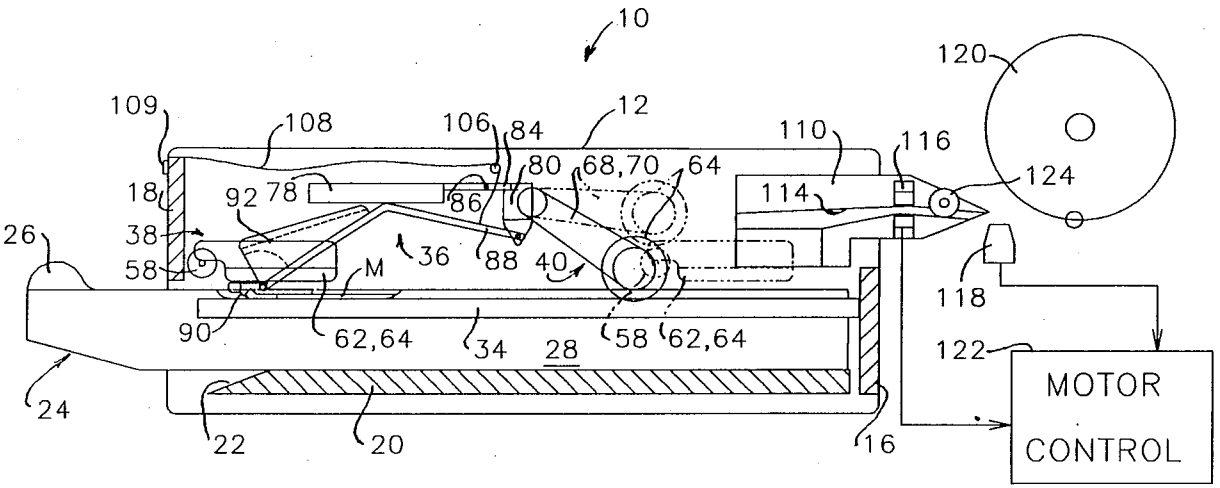
FIG. 2 is a partially schematic cross section on line 2—2 of FIG. 1.

In FIGS. 1 and 2 of the drawings, the sheet feeding apparatus incorporating the present invention is generally designated by the reference numeral 10 and shown to include a supporting chassis defined primarily by a pair of parallel side plates 12 and 14 joined at their ends by a front end wall 16 and a rear end wall 18. The side plates 12 and 14 are otherwise interconnected by components including a cassette shelf 20 (FIG. 2) having a ramp-like rear end portion 22 to facilitate insertion of a media cassette 24. As may be seen in FIGS. 1 and 2, the cassette 24 has a rearwardly extending handle portion 26 and a box-like major portion defined by side walls 28 and a front end wall 30. Vertical spacers 32 are provided about the inner wall surfaces of the cassette 24 to position a stack of sheet media M therein. In addition to the shelf 20, the chassis of the apparatus 10 is provided with a generally U-shaped fence 34 (FIG. 2) for determining the inserted position of the cassette 24. The cassette 24 is open at its top for feeding removal of the media M, one sheet at a time, in a manner to be described.

The major working component assemblies included in the apparatus 10 for feeding individual sheets of the media M from the cassette 24 include a pick assembly 36, a lifting roller assembly 38 and a drive roller assembly 40. These assemblies are independently driven by motors 42, 44 and 46, respectively, supported by a mounting plate 48 secured to the side plate 14. As described in the afore-mentioned co-pending application Ser. No. 324,036, the output of the motors 42, 44 and 46 to the respective component assemblies is through independent belt and sprocket drives which are represented in composite block diagram form in FIG. 1 as a drive transmission 50. The connection between the drive transmission 50 and the respective component assemblies are indicated by dashed lines 52, 54 and 56 in FIG. 1.

As shown in FIGS. 1 and 2, the lifting roller assembly 38 includes an elongated roller 58 freely journalled at opposite ends in carriage members 60 and 62 which are slidable or otherwise translatable from the position shown in FIG. 1 and in solid lines in FIG. 2 to the phantom line position of FIG. 2. Similarly, the drive roller assembly 40 is embodied in the apparatus 10 as a single traction roller 64 supported centrally on a shaft 66 extending to swinging ends of respective pivot links 68 and 70. The other end of each link 68 and 70 is pivotally supported by respective stub axles 72 and 74 from the side plates 12 and 14. As shown in FIG. 1, the shaft 66, and thus the drive roller 64, are adapted to pivot about the axes of the stub axles 72 and 74 while, at the same time, the shaft and roller 64 are driven in rotation about the axis of the shaft 64 by virtue of a belt and sprocket drive 76, the sprockets of which carried concentrically with the respective axes of the stub axles 72, 74 and of the shaft 66.

Figure 3:
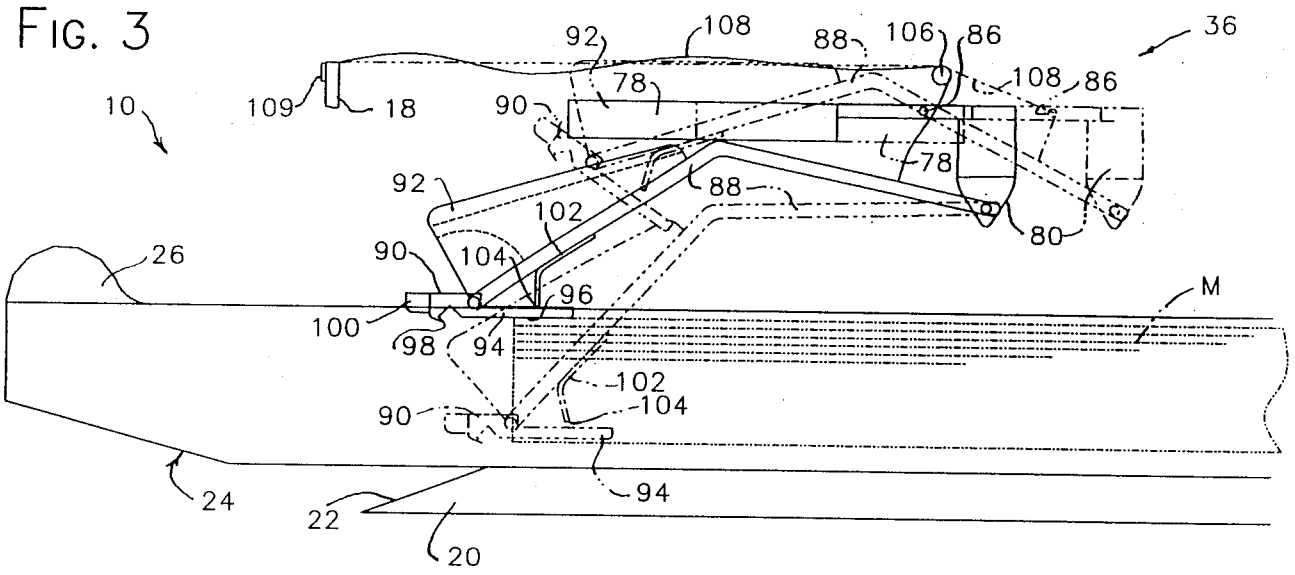
FIG. 3 is a greatly enlarged fragmentary side elevation of a component assembly of the invention.

Although the components of the pick assembly 36 are detailed most fully in FIG. 3 of the drawings, the general organization and relation to other components in the apparatus may be understood from FIGS. 1 and 2. Thus, in FIG. 1, it will be observed that the assembly 36 includes a carriage plate 78 which is supported by tracks (not shown) in the chassis plates 12 and 14 for transnational movement longitudinally of the apparatus 10. A depending pivot boss 80 (FIG. 2) is cantilevered forwardly of the carriage plate 78 by a plate 82 having an aperture 84 therein. An idler roller 86 is journalled in the opening or window 84 of the plate 82 for reasons which will become more apparent from the description of operation to follow below. As may be seen in FIG. 2, the pivot boss 80 supports one end of an angular pick arm 88 freely for pivotal movement about a horizontal axis whereas a pick member 90 is pivotally supported from the opposite end of the arm 88 on a parallel pivot axis. A weight 92 is mounted on the arm 88 at the end thereof to which the pick member 90 is pivotally connected.

The details of the pick member may be understood by reference to FIGS. 1 and 3 of the drawings. As shown in FIG. 3, the pick member 90 includes an elongated base 94 having a planar bottom surface 96 which terminates in a depending and forwardly inclined pick claw 98 which extends below the surface 96 by a distance corresponding to the approximate thickness of the sheets of media M to be fed from the cassette 24. A balancing weight 100 is secured to the rear end of the pick as may be seen in FIGS. 1 and 3. A pick stop 102 is secured to the under side of pick arm 88 and is angled so that the lower end 104 thereof restricts pivotal movement of the pick 90 to the extent that the forward end of the body 94 will engage the end 104 of the stop 102 in the approximate position shown in solid lines in FIG. 3 of the drawings.

As may be seen in FIG. 1, a rod 106 is connected to the chassis plates 12 and 14 in a position elevated above the carriage plate 78 and spaced from the rear wall 18 of the chassis by a distance so as to lie slightly behind the pivot boss 80 when the carriage is in its rearward-most position as illustrated in FIGS. 1 and 2 and in solid lines in FIG. 3 of the drawings. A flexible tensile strand or cable 108 is adjustably connected to the rear wall 18 of the chassis by a releasable anchor 109 such as a screw bolt and extends over the top of the rod 106, through the window 84 of the plate 82 in front of the idler roller 86, and is connected to the pick arm 88 near the pivoted end thereof as shown in FIG. 3. The connection of the cable 108 to the anchor 109 on the rear wall 18 facilitates adjustment in the length of the cable 108. From the standpoint of operation, however, the effective length of the cable 108 is that portion of the length thereof between the end connected to the arm 88 and the fixed rod 106 elevated above the media M and the carriage 78.

Operation of the pick assembly 36, the lifting roller assembly 38 and the drive roller assembly 40 to separate and feed the top sheet of the media stack M from the cassette 24 is generally the same as that described in the afore-mentioned co-pending application Ser. No. 324,036. Essentially, the pick assembly 36 is advanced from the position shown in FIGS. 1 and 2 so that the claw 98 engages the rear edge of the top sheet of media M. Further forward movement of the pick assembly 36 results in an upward swinging of the pick 90 as a result of the claw 98 engaging the top sheet of media M and the rear end portion of that sheet flexing upwardly into a generally arcuate conformation. The lifting roller assembly 38 is then advanced forwardly under the pick retained rear portion of the top sheet until it underlies the drive roller assembly 40, specifically the roller 64 thereof, as depicted by phantom lines in FIG. 2 of the drawings. At this time, the drive roller 64 is driven in rotation and the sheet sandwiched between the drive roller 64 and the lifting roller 58 fed upwardly and forwardly out of the cassette 24.

In the apparatus 10, the sheet being fed from the stack of media M is directed to a pair of guide shoes 110 and 112 secured respectively to the forward portion of the chassis plates 12 and 14 as shown in FIGS. 1 and 2 of the drawings. The guide shoes 110 and 112 are spaced in relation to each other so that the edges of the fed sheet of media M are supported in divergent guide tracks 114 in the guide shoes 110 and 112 as the sheet passes from the cassette 24. A first detector 116 is provided on at least one of the guide shoes 110 and 112 to indicate the presence or absence of a sheet of media in the tracks 114. A second detector 118 senses the presence or absence of the fed sheet after it passes through the guide shoes 110 and 112 on its way to a rotary drum 120 on which the fed sheet is wrapped and processed such as by printing or the like. The detectors 116 and 118 are electronically connected with a motor control unit 122 which governs operation of the respective motors 42, 44 and 46. In practice, the motor control 122 may be a computer programmed to operate the motors 42, 44 and 46 in a manner known in the art.

At least one of the drive shoes also carries a restricting roller 124 which, as will be explained in more detail below, functions to prevent the passage of more than one sheet of media M through the guide shoes 110 and 112.

Operation of the pick lifting mechanism of the present invention may be appreciated from the illustration in FIG. 3 of the drawings where the pick assembly is shown in various operating conditions relative to the cassette 24 and the stack of sheet media M contained in the cassette. In particular, it will be noted that the carriage plate 78 and its associated pivot boss 80 are shown in solid and phantom line positions in FIG. 3. These positions represent the extreme positions of the carriage 78 in operation of the pick assembly 36 and may be termed a rear position (solid line) and a forward position (phantom line). Also it will be noted in FIG. 3 that the lifting strand or cable 108 extends from the anchor 109 at the rear wall 18, forwardly over the rod 106, and down through the window 84 in the plate 82 in front of the idler roller 86 to its connection with the pick arm 88.

In the rear position of the carriage 78 as shown in solid lines in FIG. 3, it will be noted that the pick arm 88 and the pick member 90 at the free end thereof may swing from a solid line position in which the lower surface 96 on the pick body 94 is resting against the top sheet of a full stack of media M contained in the cassette. As mentioned above, the pick stop 102 in this position of the arm and pick member 90 limits pivotal movement of the pick body 94 so that it will be retained on the top surface of the uppermost sheet in the stack of media M. The phantom line position of the arm 88 and pick member 90 shown in FIG. 3, with the pick assembly carriage 78 remaining in its rear or solid line position, is swung downwardly but in the position so that forward movement of the pick member 90 will engage the bottom sheet in the stack of media M. This latter position of the pick 90 will occur as the individual sheets of media M are removed from the top of the stack contained by the cassette 24.

The swing of movement by the arm 88 and pick 90 with the carriage plate 78 in its rear position must be able to occur without interference by the lifting cable 108. This requirement is satisfied by adjusting the length of the cable so as to remain in a slack condition throughout movement of the pick arm 88 and pick 90 between the solid line and lower phantom line positions illustrated in FIG. 3 of the drawings.

In a forward position of the carriage 78 and pivot boss 80, the pick arm 88 and pick 90 are lifted to an elevated position so that the pick member 90 is well above and clear of the cassette 24. This condition is achieved by the cable 108 which is now in a taut condition as a result principally of forward movement of the carriage 78 and in particular the idler roller 86 carried thereby. In other words, as the idler roller 86 moves from the rear solid line position in FIG. 3 to the forward phantom line position in that drawing illustration, any slack existing in the cable 108 is taken up and the cable made operative to lift the arm 88 upwardly as shown.

It should be noted that the point in the forward movement of the carriage plate and idler roller 86 where the condition of the cable 108 changes from a slack condition to a taut condition, initiating lifting movement of the arm 88, is not critical to the operation of the pick arm in its movement to lift a sheet of media M upwardly for passage of the lifting roller 58 thereunder. In other words, the initial lifting of the pick arm principally by the flexing action of the sheet of media M may tend to maintain the slack condition of the cable even though the pick arm would be lifted upwardly by the cable if no sheet of media had been engaged. On the other hand, if no media sheet has been engaged by the pick, causing it to be elevated from either one of the positions shown in FIG. 3 and during which the carriage 78 is in its rear position, the cable will be operative to lift the pick 90 and particularly the claw 98 thereof away from the top surface of the media sheet which otherwise would have been fed had the claw engaged that sheet. Similarly, on return of the carriage 78 from the phantom line forward position of FIG. 3 to the operative rear and solid line position, the pick is gently returned to the top surface of the sheet media always under the control of the lifting cable 108. In this respect, a combination of the length of the pick body 94 and the stop 102 enable the length of the cable 108 to be adjusted so that the claw 98 of the pick 90 is kept from contact with the top surface of the sheet media M throughout the full height of the stack.

Figure 4:
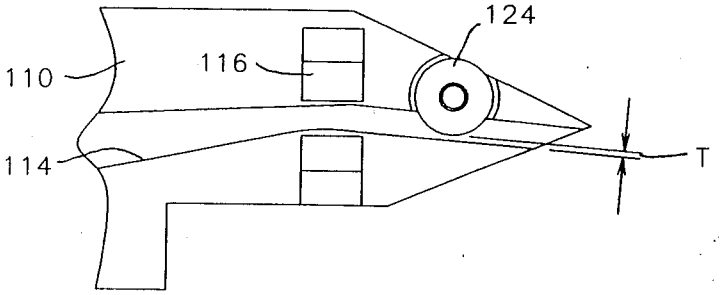
FIG. 4 is an enlarged fragmentary side elevation of the pick mechanism of the present invention in several conditions of operation.

As mentioned above with respect to FIGS. 1 and 2 of the drawings, the detectors 116 and 118 are used by the motor control unit 122 to control operation of the respective motors 42, 44 and 46. Thus, if no sheet of media M is sensed by the detector 116, the motor control unit 122 becomes effective to return the pick assembly 36 to the rear position of the carriage thereof make a second pass on the same sheet of media M. The detector 118 on the other hand is located so that it will sense the presence of a sheet of media M beyond the forward end of the guide track 114 in the guide shoes 110 and 112. If no sheet is sensed by the detector 118, it is either because no sheet is sensed by the detector 116 as a result of failure of the pick 90 to engage a sheet, or it is because the sheet has not passed from the track 114. This latter condition may occur as a result of the stop roller 124 shown most clearly in FIG. 4 of the drawings. In particular, it will be noted that the roller 124 is of a diameter such that its peripheral surface is spaced from the lower surface of the track 114 by a distance T equal to the approximate thickness of one sheet of media M. Thus, if more than one sheet of media were to be passed to the guide track 114, the added thickness represented by the additional sheet or sheets would result in a jamming action by which all sheets would be prevented by passing the roller 124. This condition would be sensed by the detector 116 indicating the presence of a sheet whereas the detector 18 indicates the absence of a sheet. The logic presented by this combination of detector conditions is then used to interrupt any further driving action by the motors 42–46 through the motor control unit 122 until the condition is corrected by the operator of the apparatus.

Thus it will be appreciated that as a result of the present invention, an improved sheet feeding apparatus is provided by which the stated objectives, among others, are completely fulfilled. Also it will be apparent to those skilled in the art from the preceding description and accompanying drawing illustrations that modifications and/or changes may be made in the disclosed embodiment without departure from the invention. Accordingly, it is expressly intended that the foregoing description and accompanying drawing illustrations is illustrative of a preferred embodiment only, not limiting, and that the true spirit and scope of the present invention be determined by reference to the appended claims.

We claim:

1. In a sheet handling apparatus for separating and feeding individual sheets from the top of a stack of superposed sheets influenced by forces causing the sheets to adhere to one another, each sheet having top and bottom surfaces and front and rear edges, said apparatus including a pick for engaging and lifting the rear edge of each successive top sheet from the remainder of the stack, carriage means supporting said pick for horizontal translating movement including forward movement to advance said pick into engagement with the rear edge of each top sheet while the front edge of that sheet is maintained against movement, thereby to cause the sheet and the pick to be lifted as the rear portion of the sheet is elevated to a concave arcuate configuration, the improvement comprising:

pick lifting means for elevating said pick during forward translating movement of said carriage means independently of pick lifting movement caused by engagement of said pick with the top sheet in said stack.

2. The sheet handling apparatus recited in claim 1, including a cassette for supporting said stack and means to support said cassette for insertion and removal by horizontal movement of the cassette, said carriage being translatable between front and rear limits of travel, and wherein said pick is lifted clear of said cassette when said carriage is at said front limit of travel.

3. The sheet handling apparatus recited in claim 1, including a rearwardly depending arm pivotally connected at one end to said carriage means and connected at the other end thereof to said pick, said pick lifting means comprising a flexible cable fixed at one end elevated above said stack and connected to said arm at the other end thereof.

4. The sheet handling apparatus recited in claim 3, wherein said carriage means includes means to engage said cable between the ends thereof during forward movement of said carriage, thereby to cause the end of said cable connected to said arm to move toward the fixed end during at least the terminal portion of carriage movement toward said front limit of travel.

5. The sheet handling apparatus recited in claim 4, wherein the length of said cable between the ends thereof provides slack in said cable when said carriage is at said rear limit of travel for all positions of said pick in relation to the successive top sheets throughout the height of said stack.

6. The sheet handling apparatus recited in claim 4, wherein said means to engage said cable comprises an idler roller journalled in said carriage on an axis extending transverse to the direction of carriage movement.

7. The sheet handling apparatus recited in claim 3, wherein said pick comprises an elongated body having a bottom surface to lie against the top surface of the top sheet in said stack and a forwardly directed pick claw near the rear end of said body to engage the rear edge of the top sheet.

8. The sheet handling apparatus recited in claim 7, wherein said pick body is pivotally connected to the other end of said arm.

9. The sheet handling apparatus recited in claim 8, including stop means on said arm for limiting pivotal movement of the front end of said pick body toward said arm.

10. The sheet handling apparatus recited in claim 9, wherein said cable is of a length so that upon movement of said carriage toward said rear limit of travel, said bottom surface of said pick body is lowered onto the top sheet in said stack.

11. The sheet handling apparatus recited in claim 1, including drive means for translating said carriage means between front and rear limits of travel, means for detecting the feed of a sheet from said stack upon forward movement of said carriage and said pick, and control means for operating said drive means in accordance with the condition of sheet feed sensed by said detector means.

12. The sheet handling apparatus recited in claim 11, including guide means positioned at the front end of said stack for establishing the path of sheet feed from said stack.

13. The sheet handling apparatus recited in claim 12, wherein said detector means is supported by said guide means.

14. The sheet handling apparatus recited in claim 13, including blocking means supported by said guide means for restricting passage of more than one sheet through said guide means.

15. The sheet handling apparatus recited in claim 14, wherein said blocking means prevents the passage of any sheet through said guide means when more than one sheet is fed to said guide means.

16. The sheet handling apparatus recited in claim 15, including second detector means connected to said control means for interrupting said drive means upon the occurrence of more than one sheet being fed to said guide means.

* * * * *